US012344995B2

(12) United States Patent
Anderson

(10) Patent No.: US 12,344,995 B2
(45) Date of Patent: Jul. 1, 2025

(54) EXTENDED NIP PRESS APPARATUS

(71) Applicant: Occzendo AB, Spånga (SE)

(72) Inventor: Tomas Anderson, Spånga (SE)

(73) Assignee: Occendo AB, Spånga (SE)

( * ) Notice: Subject to any disclaimer, the term of this patent is extended or adjusted under 35 U.S.C. 154(b) by 0 days.

(21) Appl. No.: 18/852,533

(22) PCT Filed: Mar. 28, 2023

(86) PCT No.: PCT/EP2023/058001

§ 371 (c)(1),
(2) Date: Sep. 30, 2024

(87) PCT Pub. No.: WO2023/186894

PCT Pub. Date: Oct. 5, 2023

(65) Prior Publication Data

US 2025/0101682 A1 Mar. 27, 2025

(30) Foreign Application Priority Data

Mar. 29, 2022 (SE) ..... 2250389-0

(51) Int. Cl.
*D21F 3/02* (2006.01)
*D21F 3/10* (2006.01)
*D21F 7/12* (2006.01)

(52) U.S. Cl.
CPC ..... *D21F 3/0209* (2013.01); *D21F 3/10* (2013.01); *D21F 7/12* (2013.01)

(58) Field of Classification Search
None
See application file for complete search history.

(56) References Cited

U.S. PATENT DOCUMENTS 2,696,148 A 12/1954 Hornbostel
2008/0210397 A1 9/2008 Scherb et al.

FOREIGN PATENT DOCUMENTS

AT 13710 U1 7/2014
DE 102004003668 A1 10/2005
EP 0066528 A1 12/1982
(Continued)

OTHER PUBLICATIONS

'The Mini Shoe Press rebuild Concept', In: Valmet Technical paper Series, Dec., 2009, [retrieved on Oct. 11, 2022], Retrieved from the Internet: https://www.valmet.com/globalassets/media/downloads/whitepapers/board-and-paper-making/wppb_minishoepress.pdf.
(Continued)

*Primary Examiner* — Phu H Nguyen
(74) *Attorney, Agent, or Firm* — Noréns Patentbyrå AB

(57) ABSTRACT

An extended nip press apparatus (1) for removing water from a web (20), comprising a rotatable backing roll (2), an elongated press device (3, 30) cooperating with the backing roll for defining between the elongated press device (3, 30) and the backing roll (2) an extended nip (4). The elongated press device is provided with a perforated belt (5, 50). A moveable, permeable carrying medium (6*a*) is arranged to be passed through the extended nip, and to support on a surface thereof a web 20. A mechanical pressure is created between the backing roll (2) and the elongated press device in the extended nip, and a vacuum is applied to the extended nip through the elongated press device, thereby both a mechanical pressure and a vacuum is applied to a web (20) being passed through the extended nip (4) on the carrying medium (6*a*).

15 Claims, 3 Drawing Sheets

(56) References Cited

FOREIGN PATENT DOCUMENTS

| | | | |
|---|---|---|---|
| EP | 0289477 | A2 | 11/1988 |
| WO | 9533885 | A1 | 12/1995 |
| WO | 2005075736 | A2 | 8/2005 |

OTHER PUBLICATIONS

Written opinion of the international searching authority, WO2023186894, European Patent Office/ISA, Oct. 5, 2023, Münich.
International Search report, WO2023186894, European Patent Ofice, Oct. 5, 2023, Münich, Germany.
Swedish search report, priority patent 2250389-0, PRV, Oct. 20, 2022, Stockholm, Sweden.

EXTENDED NIP PRESS APPARATUS

TECHNICAL FIELD

The present document relates to an extended nip press apparatus for removing water from a web, a paper-making line comprising the extended nip pressure apparatus, and to a method of dewatering a web.

BACKGROUND ART

An extended nip press may be used in a papermaking machine for dewatering of a paper or board web. The extended nip press comprises an elongated shoe press cooperating with a backing roll for defining between the shoe and the backing roll an extended nip for passage there through of the web. The extended nip press increases the residence time of a web within the nip press such that more water can be removed from the web as compared to when two rotating rolls are used for removing water from a web.

Although the extended nip press is an improvement compared to the use of two rotating rolls, there is still a desire to improve the papermaking process and improve the dewatering/press efficiency in the extended nip.

SUMMARY OF THE INVENTION

It is an object of the present disclosure to provide an improved extended nip press apparatus as compared to known extended nip presses. Further objects are to provide a papermaking line comprising such extended nip press apparatus and to provide a method of dewatering a web.

The invention is defined by the appended independent patent claims. Non-limiting embodiments emerge from the dependent patent claims, the appended drawings and the following description.

According to a first aspect there is provided an extended nip press apparatus for removing water from a web, the apparatus comprising: a rotatable backing roll, an elongated press device cooperating with the backing roll for defining between the elongated press device and the backing roll an extended nip, wherein the elongated press device is provided with a belt provided with perforations. A moveable, permeable carrying medium is arranged to be passed through the extended nip, the carrying medium being arranged to support on a surface thereof a web, such that the carrying medium is arranged between the web and the perforated belt of the elongated press device in the extended nip. The extended nip press apparatus further comprising an arrangement for creating a mechanical pressure between the backing roll and elongated press device in the extended nip, and a device for applying a vacuum to the extended nip through the elongated press device, thereby applying both a mechanical pressure and a vacuum to a web being passed through the extended nip on the carrying medium.

The permeable carrying medium is arranged between the perforated belt of the elongated press device and the web, as the web otherwise may get stuck in the perforations of the perforated belt due to the vacuum applied.

The mechanical nip pressure may be 0-200 kN/m, which is here meant that in one embodiment the nip press apparatus may be driven with a very low mechanical nip pressure and even no mechanical nip pressure.

The mechanical pressure may be 0-200 kN/m, 1-200 kN/m, 10-200 kN/m, 50-200 kN/m, 100-200 kN/m, 150-200 kN/m, 0-150 kN/m, 1-150 kN/m, or 1-100 kN/m.

The vacuum applied may be 10-100 kPa.

The extended nip apparatus may provide both a mechanical nip pressure and a vacuum to the web in the nip. Thereby, an improved dewatering/press efficiency is achieved in the extended nip compared to if standard extended nips without vacuum are used, and there is an instant water removal from the conveyor belt inside the nip during the pressing curve.

The elongated press device cooperating with the backing roll is non-rotating. The elongated press device or portions thereof may be movable in a direction towards and away from the backing roll in the extended nip to create different pressures on the web in the nip. Alternatively, or additionally, the elongated press device or portions thereof may be tiltable in the extended nip to create different pressures on the web in the extended nip.

The elongated press device is provided with a belt with perforations. The belt is movable around/past the press device through the extended press nip.

The extended nip extends in a direction of rotation of the backing roll/in a direction of movement of the web through the extend nip pressure apparatus.

Vacuum is added as a driver of water removal within the press nip, and introduces a possibility to control dewatering through controlling pressure and vacuum along the nip.

The present extended nip press apparatus may provide a large reduction in moisture difference between bottom and top of the web through equal and effective dewatering thereof (through pressure and vacuum). There is also less rewetting upon exiting the nip due to more even distribution within the fibre structure of the web.

Without vacuum through the elongated press device, there is a more asymmetric sheet, which could require a press section configuration of at least two press nips for homogenous sheet manufacture.

The permeable carrying medium may be a permeable surface or structure, such as a permeable belt, wire, or felt, having pores or openings that permit liquids and/or gases to pass through the carrying medium. It may be made of fabric/cloth, metal or plastic.

The elongated press device may be a shoe press or a cushion press.

The extended nip press apparatus may further comprise a device for applying a vacuum to the extended nip through the backing roll, a further moveable, permeable carrying medium arranged to be passed through the extended nip, the further carrying medium being arranged to support on a surface thereof the web, thereby the web is supported by and arranged between the carrying medium and the further carrying medium, and a further perforated belt arranged between the backing roll and the further carrying medium in the extended nip.

By applying vacuum to both dewatering directions in a press nip, from the elongated press device and from the backing roll, the dry content of the web or paper web, which leaves the extended nip may be increased. Thereby, drying energy of up to 15-20% may be saved in the subsequent drying operation.

The vacuum applied may be 10-100 kPa.

The moveable, permeable carrying medium may be a belt, a wire, or a felt.

The perforated belt may be provided with an open area of 10-50%.

The open area is a ratio that reflects how much of the belt is occupied with perforations. Here 10-50% of the belt is holes and 90-50% of the belt is material. The perforations may have any shape: round, oval, slits, hexagonal etc. The diameter of the open area may for example be 2-10 mm. In one example the open area ratio is 5-25%.

The perforated belt may be provided with an open area of 10-20%, 10-30%, 10-40%, 40-50%, 30-50%, or 20-50%.

The perforated belt may be provided with a blind-hole area of 5-20% at a surface of the perforated belt arranged to face the web.

The blind holes may comprise any kind of surface recess or groove in the surface of the belt. Presence of blind holes increases the water transport capacity. The blind holes may be arranged in an even pattern on the surface of the belt.

The blind-hole area of the perforated belt may be 10-20%, 15-20%, 5-15%, or 5-10%.

The belt may be made of a material selected from metal, plastics or fabric/cloth.

The metal may e.g. be stainless steel. The plastics may e.g. be polyurethane.

The perforated belt of the elongated press device and a further perforated belt of the backing roll may have the same characteristics when it comes to type, material, open area, blind-hole area etc. Alternatively, they may differ in one or more of these features and characteristics.

The vacuum and mechanical pressure applied to the extended nip may be controlled separately.

Vacuum levels are controlled locally and/or remotely through a machine control system by varying the applied vacuum through connections, valves, and gauges. The mechanical pressure is applied hydraulically or pneumatically through the elongated press device and/or the framework as configured in the press section configuration.

The extended nip may be 3-40 cm long.

The elongated press device may extend more than a quarter of rotation of the backing roll.

The extended nip may be 5-40, 10-40, 15-40 or 20-40 cm.

The vacuum applied to the extended nip through the elongated press device may be a variable vacuum, which is variable along the nip pressure curve length.

Vacuum levels may be varied through the length of the nip by different vacuum levels applied at different zones along the nip length.

The vacuum applied to the extended nip through the backing roll may be a variable vacuum, which is variable along the nip pressure curve length.

Vacuum levels may be varied through the length of the nip by different vacuum levels applied at different zones along the nip length.

The elongated press device may be a shoe press or a cushion press.

A cushion press may comprise one or more separate cushions or press bodies, for example 1-3 cushions/press bodies. A cushion may be filled with a liquid, such as oil, or a gas. A cushion may be flexible/expandable such that the mechanical pressure applied between the backing roll and the cushion press in the extended nip can be varied. A vacuum may be applied to the web by applying vacuum to the extended nip between the separate cushions and/or before/after a cushion.

The cushion press may for example be the ViscoNip® cushion press from Valmet. A heat source may be arranged at an entrance of the extended nip.

The heat source being arranged to pre-heat the web before entering the extended nip, which could improve the dewatering process in the extended nip and the water may escape more easily thanks to increased temperature.

According to a second aspect there is provided a papermaking line comprising the extended nip press apparatus described above.

According to a third aspect there is provided a method of dewatering a web, comprising: arranging a rotatable backing roll and an elongated press device such that an extended nip is defined between the elongated press device and the backing roll, providing the elongated press device with a belt provided with perforations, arranging a moveable, permeable carrying medium for passage through the extended nip, arranging a web on a surface of the permeable carrying medium, such that the permeable carrying medium is arranged between the web and the perforated belt of the elongated press device in the extended nip, moving the carrying medium and the web arranged on a surface thereon through the extended nip, applying a mechanical nip pressure to the web when passing through the extended nip, applying a vacuum to the extended nip through the elongated press device, thereby applying a vacuum to the web when passing through the extended nip.

The web may e.g. be a paper or pulp web.

The method may further comprise to arrange a further moveable, permeable carrying medium for passage through the extended nip, the further carrying medium being arranged to support on a surface thereof the web, thereby the web is supported by and arranged between the carrying medium and the further carrying medium in the extended nip, providing a further perforated belt between the backing roll and the further carrying medium in the extended nip, and applying a vacuum to the extended nip through the backing roll.

DETAILED DESCRIPTION

An extended nip press may be used in a papermaking machine for dewatering of a paper or board web. The extended nip press increases the residence time of a web within the nip press such that more water can be removed from the web as compared to when two rotating rolls are used for removing water from a web. Below is described an improved such nip press, which improves the dewatering/press efficiency in the extended nip.

Figure 1:
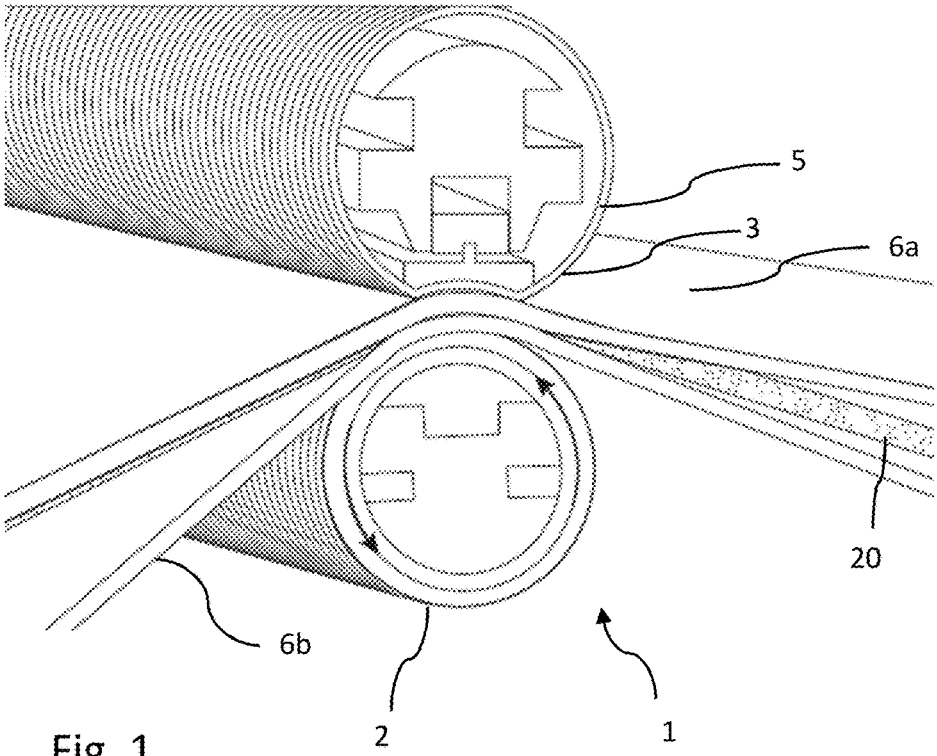
FIG. 1 shows an extended nip press apparatus comprising a rotatable backing roll and an elongated press device cooperating with the backing roll.
Figure 2:
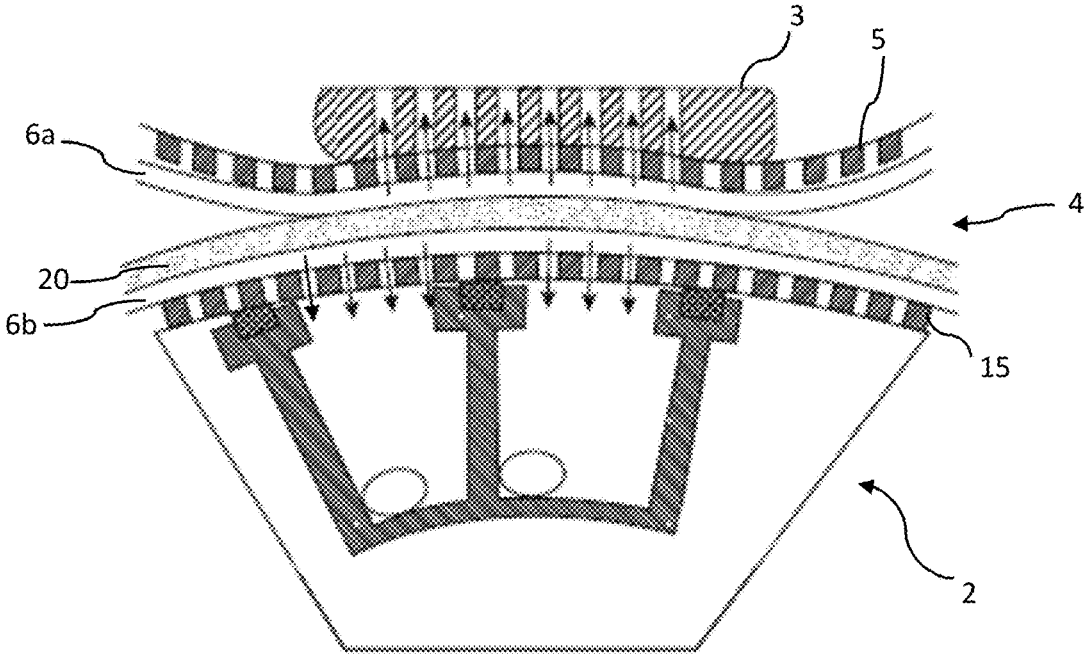
FIG. 2 shows a simplified sketch of an extended nip press, wherein vacuum suction and mechanical pressure is applied to the extended press nip from two directions, from the elongated press device, being a shoe press, and the backing roll.
Figure 3:
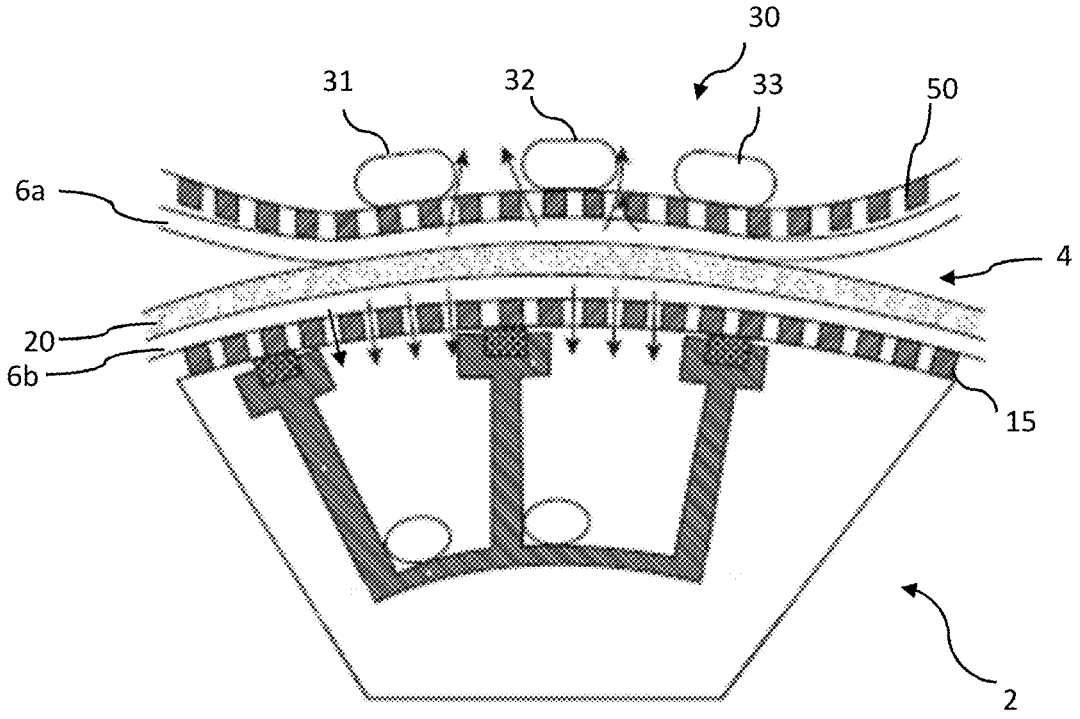
FIG. 3 shows a simplified sketch of an extended nip press, wherein vacuum suction and mechanical pressure is applied to the extended press nip from two directions, from the elongated press device, being a cushion press, and the backing roll.
Figure 5:
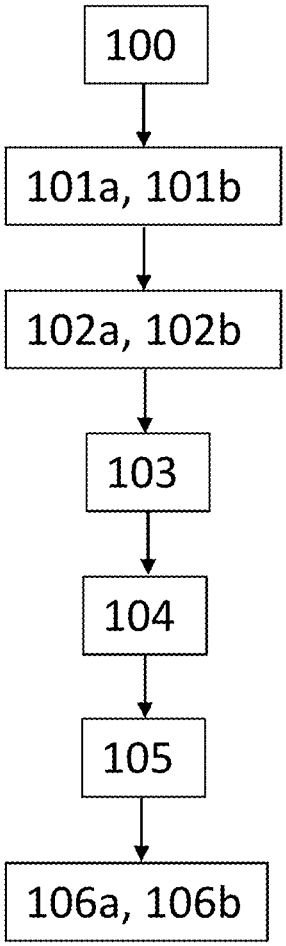
FIG. 5 schematically illustrates a method of dewatering a web.

In FIG. 1 is illustrated an extended nip press apparatus 1, which for example may be arranged as a step to extract water from the web in a papermaking line. FIGS. 2 and 3 show simplified sketches of an extended nip press comprising a shoe press and a cushion press, respectively, in such a nip press apparatus. FIG. 5 schematically illustrates a method of dewatering a web.

The extended nip press apparatus 1 comprises a rotatable backing roll 2 and an elongated press device 3, 30, in FIG. 2 illustrated as a shoe press 3 and in FIG. 3 illustrated as a cushion press 30, cooperating with the backing roll 2, defining between the elongated press device and the backing roll an extended nip 4. The elongated press device is provided with a belt 5, 50 provided with perforations (a so-called shoe belt if the elongated press device 3 is a shoe press). A moveable, permeable carrying medium 6*a* is arranged to be passed through the extended nip 4. The carrying medium 6*a* is arranged to support on a surface thereof a web 20, such as paper or board, such that the carrying medium 6*a* is arranged between the web 20 and the belt 5, 50 in the extended nip 4.

When the elongated press device is a shoe press (see FIG. 2) the shoe defines a concave surface. The stationary concavely formed press shoe presses the web 20 and the carrying medium 6*a* against the roll 2. The concavity of the shoe press is placed in close contact with and facing the rotatable backing roll 2. Thereby forming an extended nip press, a press zone. In between the roll 2 and the shoe 3, the shoe belt 5 is sliding. Due to the concave shape of the shoe, an extended nip press develops, which e.g. may be 30-300 mm.

When the elongated press device is a cushion press 30, the cushion press comprises one or more separate cushions or press bodies 31, 32, 33, for example 1-3 cushions/press bodies. In FIG. 3 the cushion press 30 is illustrated with three cushions 31, 32, 33. A cushion may be filled with a liquid, such as oil, or a gas.

The nip press apparatus 1 may comprise an arrangement for creating a mechanical pressure pointing downwards towards the shoe press 3/cushion press 30 side of the apparatus and upwards towards the back roll 2 side of the apparatus. A pressure of 0-200 kN/m may be applied between the backing roll 2 and shoe press 3/cushion press 30 in the extended nip. In the cushion press 30, a cushion may be flexible/expandable such that a mechanical pressure applied between the backing roll and the cushion press in the extended nip 4 can be varied.

There is also a device (not illustrated) for applying a vacuum to the extended nip 4 through the elongate shoe press 3 (illustrated in FIG. 2 as arrows pointing upwards from the shoe belt 5) and through the cushion press 30 (illustrated in FIG. 3 as arrows pointing upwards from the belt 50) between the separate cushions and/or before/after a cushion. Thereby, both a mechanical pressure and a vacuum is applied to a web 20 being passed through the extended nip 4 on the permeable, carrying medium 6*a*.

The described extended nip apparatus 1 provides both a mechanical nip pressure and a vacuum to the web 20 in the nip 4. Thereby, an improved dewatering/press efficiency is achieved in the extended nip 4 compared to if standard extended nips without vacuum are used, and there is an instant water removal from the permeable carrying medium 6*a* inside the nip during the pressing curve. Vacuum is added as a driver of water removal within the press nip 4, and introduces a possibility to control dewatering through controlling pressure and vacuum along the nip pressure development. As illustrated in FIGS. 2 and 3, the extended nip press apparatus 1 may further comprise a further moveable, permeable carrying medium 6*b* arranged to be passed through the extended nip 4. The further carrying medium 6*b* is arranged to support on a surface thereof the web 20, thereby the web 20 is supported by and arranged between the carrying medium 6*a* and the further carrying medium 6*b*. A further perforated belt 15 is arranged between the backing roll 2 and the further carrying medium 6*b* in the extended nip.

The apparatus may comprise a device (not illustrated) for applying a vacuum to the extended nip 4 through the backing roll 2 (illustrated in FIGS. 2 and 3 as arrows pointing downwards from the further carrying medium 6*b*). By using vacuum from both dewatering directions into a press nip 4, from the elongated press device 3, 30 and from the backing roll 2, the dry content of the web 20, which leaves the extended nip may be increased.

The vacuum and mechanical pressure applied to the extended nip 4 may be controlled separately.

The vacuum applied to the extended nip 4 through the elongated press device 3, 30 may be a variable vacuum, which is variable along the nip pressure curve length. Vacuum applied to the extended nip 4 through the backing roll 2 may be a variable vacuum, which is variable along the nip pressure curve length. If the vacuum is variable, more vacuum can be applied where it gives the most effect. How the vacuum is to be varied may depend on the product to be produced in the nip press apparatus and is also dependent on machine conditions. The vacuum conditions applied can then be optimized for different paper qualities, pulps and machine conditions. In one example, a higher vacuum may be applied in the beginning of the extended nip than at the end of the extended nip to force more water out of the web at the beginning of the press nip. In another example the vacuum applied at the beginning of the extended nip is lower than at the end of the extended nip. In yet an example, the extended nip could be divided in for example 1-3 different vacuum zones.

Figure 4:
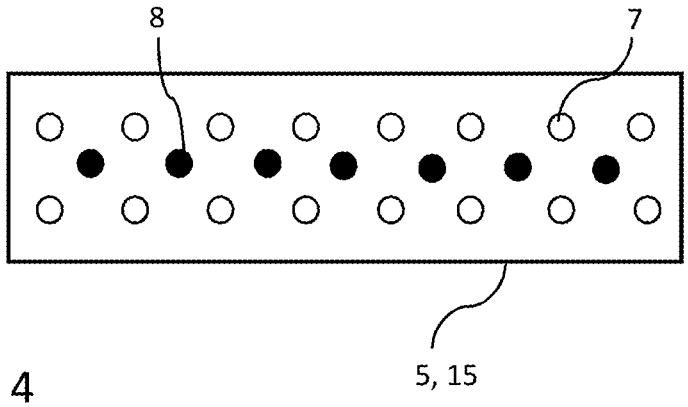
FIG. 4 illustrates a perforated belt provided with perforations and blind-holes.

In FIG. 4 is illustrated a perforated belt 5, 50, 15 which is made of a material such as metal or plastics. The perforated belt 5, 50, 15 may be provided with an open area 7 of 10-50%, the open area being a ratio that reflects how much of the belt is occupied with perforations. The perforations 7 are illustrated as being of round shape, but may in reality be of any shape, such as round, oval, slits, hexagonal etc. As illustrated in FIG. 4, the perforated belt 5, 50, 15 may be provided with a blind-hole area 8 of 5-20% at a surface of the belt arranged to face the web 20. The blind holes are here illustrated as having a round shape, but may comprise any kind of surface recess or groove in the surface of the belt 5, 50, 15. The perforations and blind-holes may be arranged in an even pattern on the surface of the belt 5, 50, 15 as illustrated in FIG. 4. Alternatively, the perforations and/or blind-holes may be arranged in irregular patterns. The perforations 7 in the belt 5, 50, 15 are needed to be able to apply a vacuum to the web 20. Presence of blind holes 8 increases the water transport capacity of the apparatus 1.

The permeable carrying medium 6*a* may e.g. be a belt, felt or wire, having pores or openings that permit liquids and/or gases to pass through the carrying medium. The felt may be a double felt 6*a*, 6*b*, wherein the web 20 is arranged between the first 6*a* and second felt 6*b* of the double felt. The carrying medium 6*a* is arranged between the perforated belt 5, 50, 15 and the web 20, as the web otherwise may get stuck in the perforations of the perforated belt 5, 50, 15 due to the vacuum applied.

A heat source (not illustrated), such as an IR-source, may be arranged at an entrance of the extended nip 4 to pre-heat the web 20 before entering the extended nip 4. This could improve the dewatering process in the extended nip 4 and the water may escape more easily in the apparatus thanks to the increased temperature of the web 20.

In FIG. 5 is illustrated a method of dewatering a web. The method comprises to arrange 100 a rotatable backing roll 2 and an elongated press device 3, 30 such that an extended nip 4 is defined between the elongated press device and the backing roll, to provide 101*a* the elongated press device 3, 30 with a belt 5, 50 provided with perforations, to arrange 102*a* a moveable, permeable carrying medium 6*a* for passage through the extended nip 4, and to arrange 103 a web 20 on a surface of the permeable carrying medium 6*a*, such that the permeable carrying medium 6*a* is arranged between the web 20 and the perforated belt 5, 50 of the elongated press device in the extended nip. The carrying medium 6*a* and the web 20 arranged on a surface thereon is moved 104 through the extended nip 4. A mechanical nip pressure, such as of 0-200 kN/m, is applied 105 to the web 20 when passing through the extended nip 4, and a vacuum is applied 106 to the extended nip 4 through the elongated press device 3, 30 thereby applying a vacuum to the web 20 when passing through the extended nip 4.

The method may further comprise to arrange 102*b* a further moveable, permeable carrying medium 6*b* for passage through the extended nip 4, the further carrying medium being arranged to support on a surface thereof the web, thereby the web is supported by and arranged between the carrying medium and the further carrying medium in the extended nip 4. A further perforated belt 15 may be provided 101*b* between the backing roll 2 and the further carrying medium 6*b* in the extended nip, and a vacuum may be applied 106*b* to the extended nip 4 through the backing roll 2.

The invention claimed is:

1. An extended nip press apparatus for removing water from a web, the apparatus comprising:

a rotatable backing roll, an elongated press device cooperating with said backing roll for defining between the elongated press device and the backing roll an extended nip, wherein the elongated press device is provided with a belt provided with perforations, a moveable, permeable carrying medium arranged to be passed through said extended nip, the carrying medium being arranged to support on a surface thereof a web, such that the carrying medium is arranged between the web and the perforated belt of the elongated press device in the extended nip, an arrangement for creating a mechanical pressure between the backing roll and the elongated press device in the extended nip, and a device for applying a vacuum to the extended nip through the elongated press device, thereby applying both a mechanical pressure and a vacuum to a web being passed through the extended nip on the carrying medium.

2. The extended nip press apparatus of claim 1, further comprising:

a device for applying a vacuum to the extended nip through the backing roll, a further moveable, permeable carrying medium arranged to be passed through said extended nip, the further carrying medium being arranged to support on a surface thereof the web, thereby the web is supported by and arranged between the carrying medium and the further carrying medium, a further perforated belt arranged between the backing roll and the further carrying medium in the extended nip.

3. The extended nip press apparatus of claim 1, wherein the moveable, permeable carrying medium is a belt, a wire, or a felt.

4. The extended nip press apparatus of claim 1, wherein the perforated belt is provided with an open area of 10-50%.

5. The extended nip press apparatus of claim 1, wherein the perforated belt is provided with a blind-hole area of 5-20% at a surface of the belt arranged to face the web.

6. The extended nip press apparatus of claim 1, wherein the perforated belt is made of a material selected from metal, plastics or fabric/cloth.

7. The extended nip press apparatus of claim 1, wherein the vacuum and mechanical pressure applied to the extended nip are controlled separately.

8. The extended nip press apparatus of claim 1, wherein the extended nip is 3-40 cm long.

9. The extended nip press apparatus of claim 1, wherein vacuum applied to the extended nip through the elongated press device is a variable vacuum, which is variable along the nip pressure curve length.

10. The extended nip press apparatus of claim 2, wherein vacuum applied to the extended nip through the backing roll is a variable vacuum, which is variable along the nip pressure curve length.

11. The extended nip press apparatus of claim 1, wherein the elongated press device is a shoe press or a cushion press.

12. The extended nip press apparatus of claim 1, wherein a heat source is arranged at an entrance of the extended nip.

13. A papermaking line comprising the extended nip press apparatus of claim 1.

14. A method for dewatering a web, comprising:

arranging a rotatable backing roll and an elongated press device such that an extended nip is defined between the elongated press device and the backing roll, providing the elongated press device with a belt provided with perforations, arranging a moveable, permeable carrying medium for passage through the extended nip, arranging a web on a surface of said permeable carrying medium, such that that the permeable carrying medium is arranged between the web and the perforated belt of the elongated press device in the extended nip, moving the carrying medium and the web arranged on a surface thereon through the extended nip, applying a mechanical nip pressure to the web when passing through the extended nip, applying a vacuum to the extended nip through the elongated press device, thereby applying a vacuum to the web when passing through the extended nip.

15. The method of claim 14 further comprising:

arranging a further moveable, permeable carrying medium for passage through the extended nip, the further carrying medium being arranged to support on a surface thereof the web, thereby the web is supported by and arranged between the carrying medium and the further carrying medium in the extended nip, providing a further perforated belt between the backing roll and the further carrying medium in the extended nip, applying a vacuum to the extended nip through the backing roll.

* * * * *